US007228697B2

(12) United States Patent
Yoon et al.

(10) Patent No.: US 7,228,697 B2
(45) Date of Patent: Jun. 12, 2007

(54) INTEGRATED AIR CONDITIONER HAVING CONDENSER CASING

(75) Inventors: Kyung Ho Yoon, Suwon (KR); Heung Seob Choi, Suwon (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 472 days.

(21) Appl. No.: 10/796,204

(22) Filed: Mar. 10, 2004

(65) Prior Publication Data

US 2005/0039477 A1 Feb. 24, 2005

(30) Foreign Application Priority Data

Aug. 20, 2003 (KR) ..... 10-2003-0057454

(51) Int. Cl.
*F25D 23/12* (2006.01)

(52) U.S. Cl. ..... 62/262; 62/298

(58) Field of Classification Search ..... 62/262, 62/298, 419, 426, 429, 428
See application file for complete search history.

(56) References Cited

U.S. PATENT DOCUMENTS 2,939,297 A * 8/1960 Karger et al. ..... 62/298
3,378,199 A * 4/1968 Snell ..... 236/49.5
3,766,749 A * 10/1973 Livesay ..... 62/262
5,388,426 A * 2/1995 Wada et al. ..... 62/263
6,085,538 A * 7/2000 Bascaran et al. ..... 62/262

FOREIGN PATENT DOCUMENTS

KR 2002-36914 5/2002

* cited by examiner

*Primary Examiner*—Melvin Jones
(74) *Attorney, Agent, or Firm*—Staas & Halsey LLP

(57) ABSTRACT

An integrated air conditioner, including a condenser casing to house a condenser and a condenser fan therein, the condenser casing including a front plate, an upper cover extending from an upper edge of the front plate, and a plurality of hinges integrally provided between the front plate and the upper cover, spaced apart from at regular intervals, wherein the upper cover rotates around the hinges be perpendicular to the front plate.

12 Claims, 4 Drawing Sheets

INTEGRATED AIR CONDITIONER HAVING CONDENSER CASING

CROSS-REFERENCE TO RELATED APPLICATIONS

This application claims the benefit of Korean Patent Application No. 2003-57454, filed Aug. 20, 2003 in the Korean Intellectual Property Office, the disclosure of which is incorporated herein by reference.

BACKGROUND OF THE INVENTION

1. Field of the Invention

The present invention relates, in general, to integrated air conditioners, and, more particularly, to an integrated air conditioner having a condenser casing which prevents noise from being generated, and prevents a condenser fan from being damaged or broken, due to contact between the condenser casing and the condenser fan.

2. Description of the Related Art

Typically, air conditioners are classified into two types, the two types being integrated air conditioners and separate-type air conditioners. In the integrated air conditioners, an evaporator, a condenser, and a compressor are installed in a cabinet. On the other hand, in the separate-type air conditioners, the evaporator is installed in an indoor unit, which is placed in a room, while the condenser and the compressor are installed in an outdoor unit, which is placed outside the room.

The cabinet of the integrated air conditioner is partitioned into a first interior chamber, which is placed in the room, and a second interior chamber, which is placed outside the room, by a partition which is vertically arranged in the cabinet. In this case, the evaporator is placed in the first interior chamber, while the condenser and the compressor are placed in the second interior chamber. Further, a cooling fan is placed in the first interior chamber to draw the indoor air into the cabinet and pass the indoor air through the evaporator to be cooled prior to discharging the cool air to the room. A condenser fan is placed in the second interior chamber to draw outdoor air into the cabinet and pass the outdoor air through both the condenser and the compressor prior to discharging the air to the outside, thus cooling the condenser and the compressor.

A condenser casing, which houses the condenser fan and the condenser therein, is also placed inside the second interior chamber. The condenser casing functions to guide air from the condenser fan through the condenser to the outside so that the condenser is effectively cooled.

A conventional condenser casing includes a front plate, two side plates, and an upper cover. The front plate, the two side plates, and the upper cover are integrally formed as a single structure to receive the condenser fan and the condenser in the condenser casing. The upper cover has a thin folding line part at a position which is spaced apart from the front plate by a predetermined distance. The upper cover is bent along the folding line part so that the condenser is installed under the upper cover having a predetermined length.

When the condenser casing having the front plate, the side plates, and the upper cover is prepared, a bending part of the upper cover, corresponding to a rear portion of the folding line part, stands upright to define an opening at a rear section of the upper cover between the two side plates in such a state, the condenser fan and the condenser are installed into the condenser casing, through the defined opening, between the two side plates. Thereafter, the bending part is bent downward and rearward until the bending part is placed horizontally, on a plane with the rest of the upper cover, and a rear end of the bending part is held on an upper surface of the condenser.

However, in the conventional condenser casing, the folding line part of the upper cover is continuously formed from a first side edge to a second side edge of the upper cover, and the condenser fan is installed under the folding line part. Thus, when the bending part of the upper cover is bent horizontally, and the rear end of the bending part is held on the condenser, after the condenser fan and the condenser are installed into the condenser casing through the opening defined between the two side plates, a residual stress in the structure of the upper cover may be generated and remain in the folding line part. Therefore, a portion around the folding line part is apt to sag.

Due to the sagging of the folding line part of the upper cover, the portion around the folding line part may come into contact with the condenser fan. When the condenser fan is rotated in such a state, noise is generated due to the contact between the condenser fan and the portion around the folding line part which sags. Cracks may also be generated in the condenser fan, resulting in damage or breakage of the condenser fan.

SUMMARY OF THE INVENTION

Accordingly, it is an aspect of the present invention to provide an integrated air conditioner having a condenser casing which prevents noise from being generated, and prevents a condenser fan from being damaged or broken, due to contact between the condenser casing and the condenser fan.

Additional aspects and/or advantages of the invention will be set forth in part in the description which follows and, in part, will be obvious from the description, or may be learned by practice of the invention.

The above and/or other aspects are achieved by an integrated air conditioner having a condenser casing which houses a condenser and a condenser fan therein, and includes a front plate, an upper cover, and a plurality of hinges. The upper cover extends from an upper edge of the front plate. The hinges are integrally provided between the front plate and the upper cover, spaced apart at regular intervals. The upper cover rotates around the hinges to be perpendicular to the front plate.

The hinges may be positioned in front of the condenser fan, which is provided under the upper cover, so that the condenser fan is operated at a position which is offset from the hinges.

The upper cover may include a step portion, a front portion, and a rear portion. The step portion may be provided along a middle portion of the upper cover. The front portion may be provided in front of the step portion, so as to be lower than the step portion. The rear portion may be provided in back of the step portion, so as to be higher than the step portion. The step portion, the front portion, and the rear portion may be formed as a single structure, and the condenser fan may be provided under the rear portion of the upper cover to allow a gap between the condenser fan and the upper cover.

A hook may project from an inner surface of the upper cover at a rear edge of the upper cover to lock the upper cover to the condenser.

The condenser may comprise a refrigerant pipe, and the hook may be provided with an arc-shaped groove corresponding to a shape of the refrigerant pipe so as to fit over the refrigerant pipe.

Further, a screw hole may be formed at a rear portion of the upper cover to couple the upper cover to an upper end of the condenser.

At least one rim may be provided along the rear portion of the upper cover to increase a structural strength of the upper cover.

BRIEF DESCRIPTION OF THE DRAWINGS

These and/or other aspects and advantages of the invention will become apparent and more readily appreciated from the following description of an embodiment, of the present invention taken in conjunction with the accompanying drawings of which.

DETAILED DESCRIPTION OF THE PREFERRED EMBODIMENTS

Figure 1:
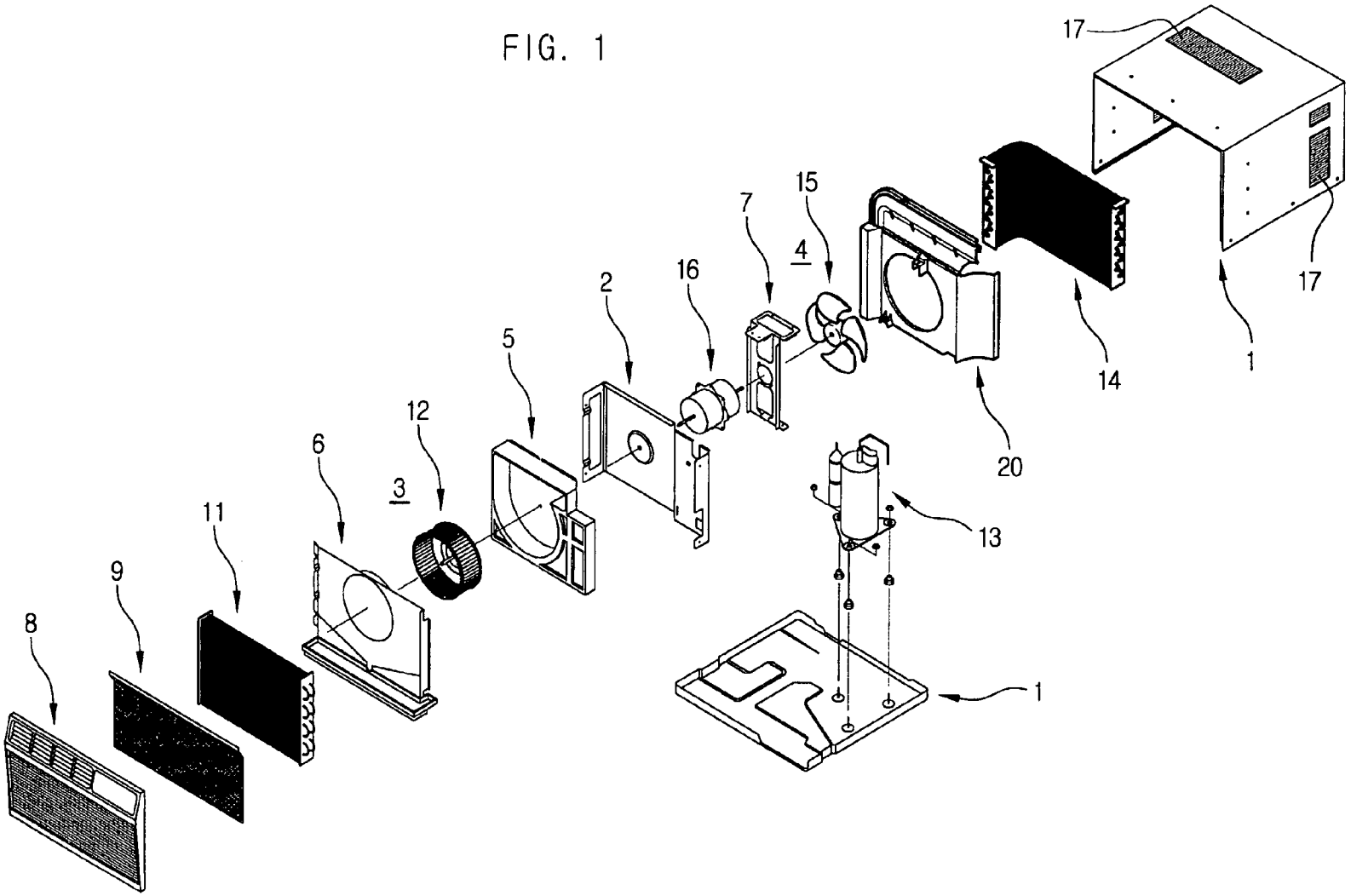
FIG. 1 is an exploded perspective view of an integrated air conditioner having a condenser casing, according to an embodiment of the present invention.

Reference will now be made in detail to an embodiment of the present invention, examples of which are illustrated in the accompanying drawings, wherein like reference numerals refer to like elements throughout. The embodiment is described below to explain the present invention by referring to the figures.

FIG. 1 is an exploded perspective view of an integrated air conditioner having a condenser casing, according to an embodiment of the present invention. As shown in FIG. 1, the integrated air conditioner includes a cabinet 1 which is box-shaped and defines an external appearance of the integrated air conditioner. The cabinet 1, which includes a cover and a base panel, is typically installed on a wall of a building so that a front portion is projected into a room and a rear portion thereof extends outside of the building. An evaporator 11, a cooling fan 12, a compressor 13, a condenser 14, and a condenser fan 15 are installed in the cabinet 1. The evaporator 11 and the cooling fan 12 function to cool indoor air. A refrigerant, which circulates through a refrigerant pipe forming a closed refrigeration circuit to execute a phase change, is compressed in the compressor 13. The condenser 14 and the condenser fan 15 function to condense the gas refrigerant fed from the compressor 13.

The cabinet 1 is partitioned into a first interior chamber 3, which is placed in the room, and a second interior chamber 4, which is placed outside the room, by a partition 2 which is vertically arranged in the cabinet 1. In this case, the evaporator 11 and the cooling fan 12 are placed in the first interior chamber 3, while the compressor 13, the condenser 14, and the condenser fan 15 are placed in the second interior chamber 4.

The cooling fan 12 of the first interior chamber 3 and the condenser fan 15 of the second interior chamber 4 are mounted to output shafts provided at both ends of a drive motor 16 which is placed in the second interior chamber 4, so that the cooling fan 12 and the condenser fan 15 are simultaneously operated. The cooling fan 12 is set in a fan casing 5 which is mounted to a front of the partition 2. The evaporator 11 is mounted to a front of an evaporator frame 6 which is placed in front of the fan casing 5.

A motor frame 7 is mounted to a back of the partition 2 to fix the drive motor 16. A condenser casing 20 is provided in back of the motor frame 7 to house the condenser 14 and the condenser fan 15 therein.

A front panel 8, which has an inlet port and an outlet port, is mounted to a front of the cabinet 1. A filter 9 is placed between the front panel 8 and the evaporator 11 to filter room air which flows into the cabinet 1 through the front panel 8. Further, a rear panel (not shown) is mounted to a rear end of the cabinet 1, and has an outlet port to discharge outdoor air from the second interior chamber 4 to the outside of the cabinet 1. Inlet ports 17 are provided on an upper surface and both side surfaces at a rear portion of the cabinet 1 so that the outdoor air flows into the second interior chamber 4 through the inlet ports 17, and is discharged to the outside of the cabinet 1 through the outlet port of the rear panel.

In the integrated air conditioner constructed as described above, when the compressor 13 and the drive motor 16 are operated to rotate the cooling fan 12, indoor air flows into the first interior chamber 3 through the inlet port of the front panel 8, passes through the evaporator 11 to become cold air, and is then discharged to the room through the outlet port of the front panel 8, thus lowering the room's temperature. Simultaneously, by an operation of the condenser fan 15, outdoor air flows into the second interior chamber 4 through the inlet ports 17 to cool the compressor 13 and the condenser 14. Subsequently, the outdoor air is discharged to the outside through the outlet port of the rear panel (not shown). Through such an operation, the room maintains a preset temperature. The assembly of the condenser casing 20 according to an embodiment of the present invention will now be described in detail with reference to FIGS. 2 to 4.

Figure 2:
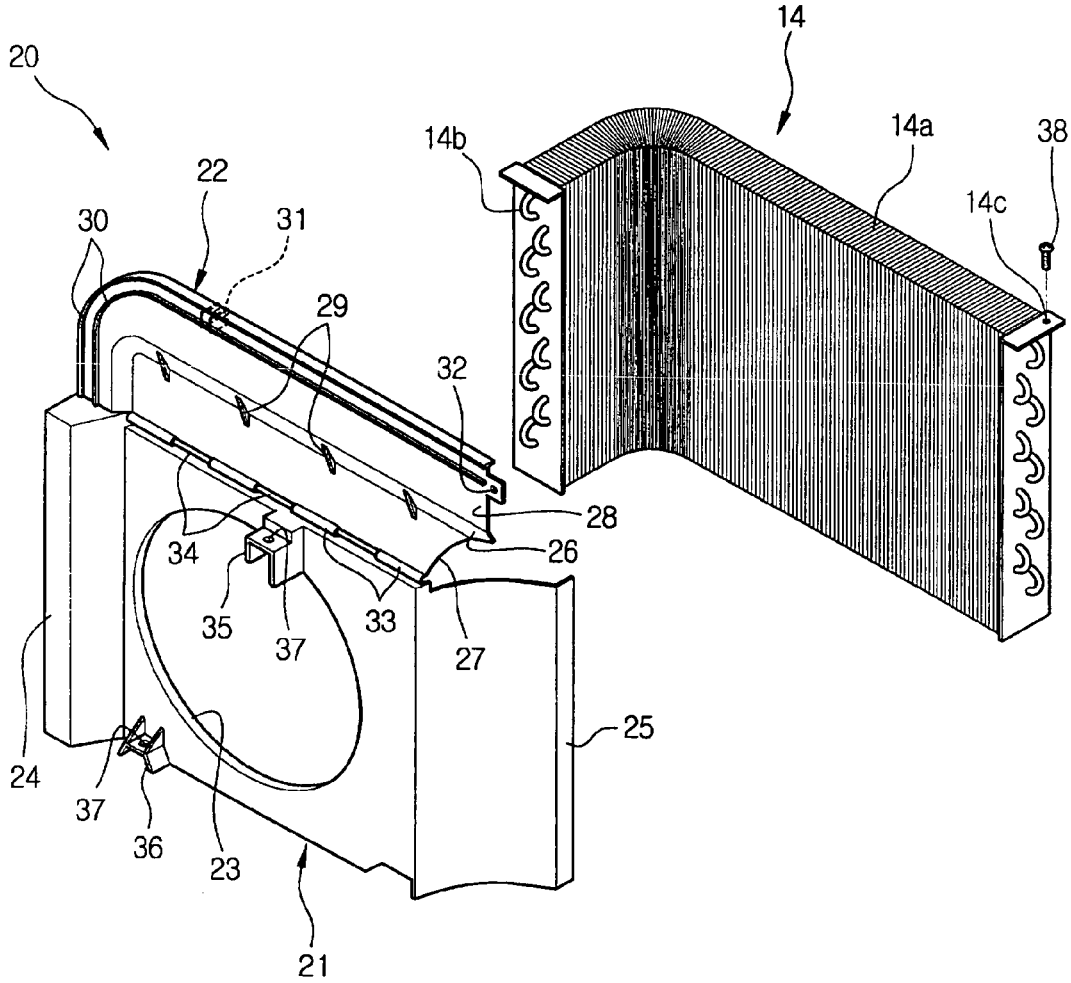
FIG. 2 is a perspective view of a condenser and the condenser casing included in the integrated air conditioner of FIG. 1, prior to being assembled.
Figure 3:
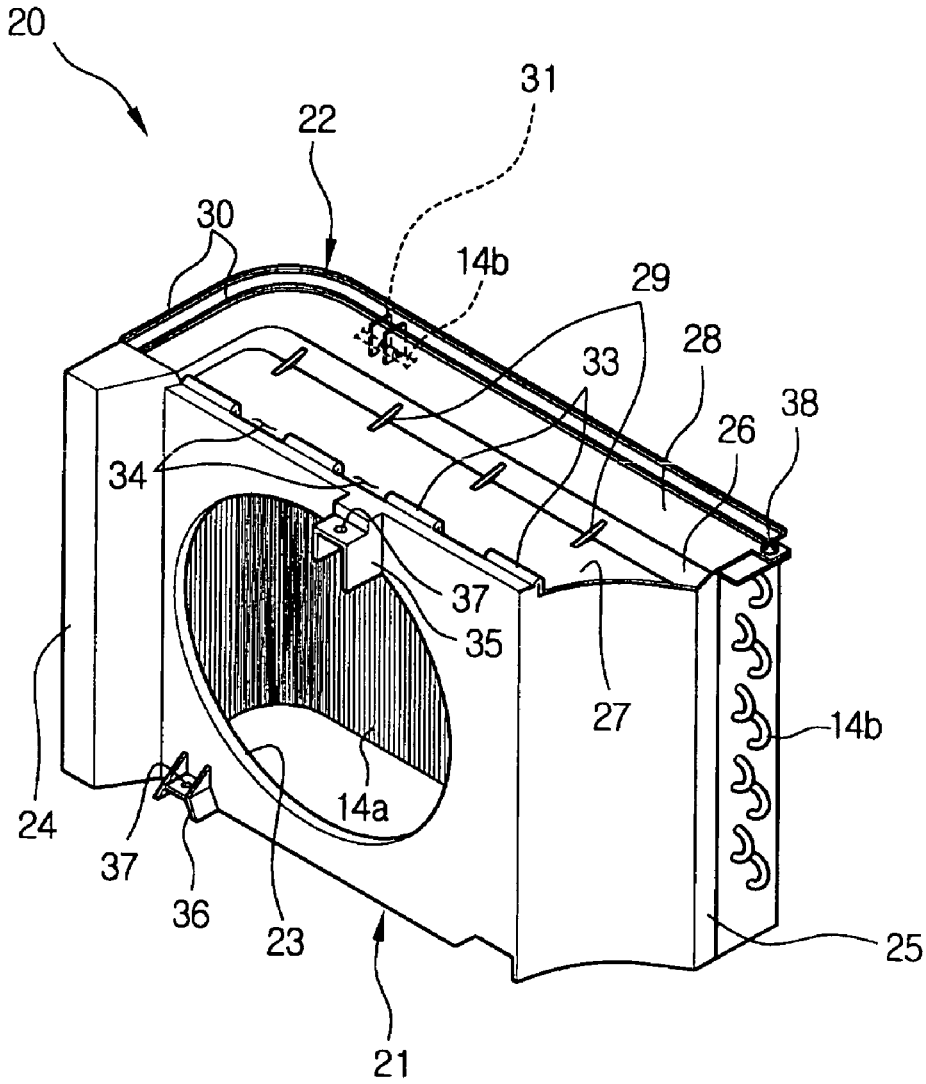
FIG. 3 is a perspective view of the condenser assembled with the condenser casing of FIG. 2.
Figure 4:
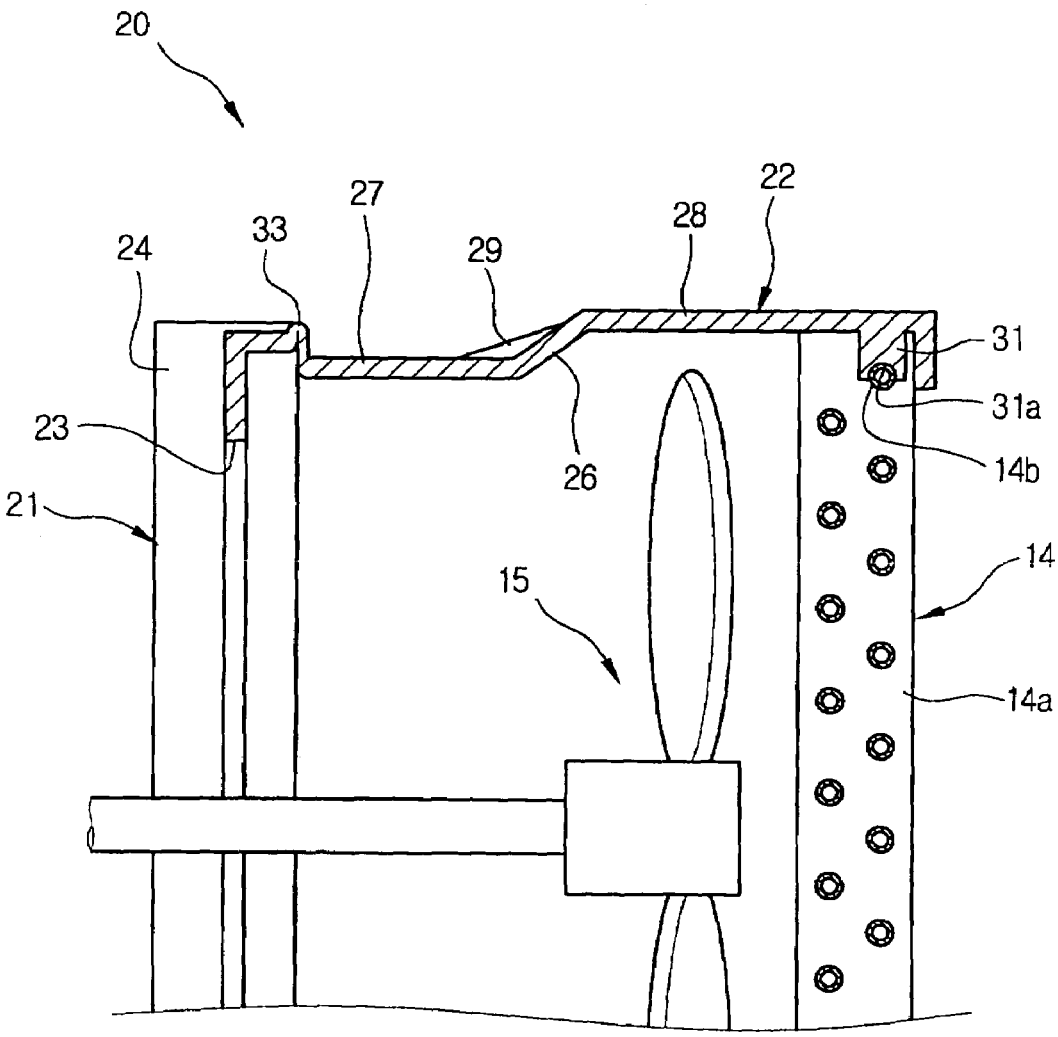
FIG. 4 is a sectional view of the condenser and a condenser fan which are installed in the condenser casing of FIG. 3.

FIG. 2 is a perspective view of the condenser 14 and the condenser casing 20 included in the integrated air conditioner of FIG. 1, prior to being assembled. FIG. 3 is a perspective view of the condenser 14 assembled with the condenser casing 20 of FIG. 2. FIG. 4 is a sectional view of the condenser 14 and the condenser fan 15 which are installed in the condenser casing 20 of FIG. 3.

As shown in FIG. 2, the condenser casing 20 includes a front plate 21, and an upper cover 22 which upwardly extends from the front plate 21. In this case, the front plate 21 and the upper cover 22 are integrally formed as a single structure.

The front plate 21 has an opening 23 at a center thereof so that the condenser fan 15 may be set in the condenser casing 20 through the opening 23. Further, outdoor air flows through the inlet ports 17 of the cabinet 1 and the opening 23 to the condenser fan 15 which is set in the condenser casing 20. As shown in FIG. 2, the front plate 21 has a recess part 24 at a left side thereof to receive a left end of the condenser 14, which is bent forward. At a right side of the front plate 21 is provided a cover part 25 to cover a right side of the condenser 14, thus preventing air from escaping from the right side of the condenser 14.

The upper cover 22 covers an upper end of the condenser 14 to allow air blown by the condenser fan 15 to efficiently pass through the condenser 14. The upper cover 22 has a step portion 26, a front portion 27, and a rear portion 28. The step portion 26 is provided along a middle portion of the upper cover 22 to be inclined upwardly, thus stepping the upper cover 22. The front portion 27 is provided in front of the step portion 26, and is lower than the step portion 26. The rear portion 28 is provided in back of the step portion 26, and is higher than the step portion 26. Further, a plurality of ribs 29 are arranged along the step portion 26 at regular intervals, to increase the structural strength of a part around the step portion 26, thus preventing the part around the step portion 26 from being deformed.

The step portion 26 extends horizontally and continuously along a rear edge and a left side edge of the upper cover 22, from a right side edge of the upper cover 22, while being spaced apart from the rear and left side edges. Thus, a left side part of the upper cover 22 and the rear portion 28 of the upper cover 22 form a same plane.

A plurality of rims 30 extend along the rear and left edge of the upper cover 22, thus allowing the rear portion 28 to have more structural strength, and thereby preventing the rear portion 28 from being easily deformed. Further, a hook 31 is downwardly projected from an inner surface of the left side of the rear portion 28, and a screw hole 32 is formed at a right side end of the rear portion 28, to mount the upper cover 22 to an upper portion of the condenser 14.

The front plate 21 and the upper cover 22, constructed as described above, are coupled to each other by a plurality of hinges 33, which are provided between the front plate 21 and the upper cover 22. The hinges 33 are placed along a horizontal direction between an upper edge of the front plate 21 and a front edge of the upper cover 22. The hinges 33 are placed so as to be spaced apart from each other at regular intervals. Thus, long and narrow slits 34 are defined among the hinges 33. Since the plurality of hinges 33 are spaced apart from each other by the plurality of slits 34 which are formed among the hinges 33, a residual stress is not generated in the hinges 33, even when the upper cover 22 is folded backward to be perpendicular to the front plate 21. Therefore, the front portion 27 of the upper cover 22 is not deformed.

An upper bracket 35 and a lower bracket 36 are respectively provided on upper and lower portions of a front surface of the front plate 21 so that the condenser casing 20 is mounted at upper and lower portions thereof to the motor frame 7 and the base panel (see, FIG. 1) of the cabinet 1, respectively. Each of the upper and lower brackets 35 and 36 has a screw hole 37.

Thus, the front plate 21 is integrated with the upper cover 22 to form the condenser casing 20. The condenser casing 20, having the single structure described above, is placed on the base panel of the cabinet 1, and screws are respectively tightened into the screw holes 37 of the upper and lower brackets 35 and 36. At this time, the upper cover 22 extends upwardly from the front plate 21.

During the assembling of the condenser casing 20, the condenser fan 15 may be mounted to the drive motor 16 before the condenser casing 20 is installed on the base panel of the cabinet 1. In this case, the condenser fan 15 is placed in the condenser casing 20 through the opening 23 of the front plate 21, so that the front plate 21 is arranged in front of the condenser fan 15. Of course, the condenser fan 15 may also be mounted to the drive motor 16 after the condenser casing 20 is screwed to the motor frame 7 and the base panel of the cabinet 1.

In such a state, the condenser 14, which has a plurality of heat transfer fins 14*a* and a refrigerant pipe 14*b*, is placed in back of the front plate 21, and a lower end of the condenser 14 is mounted to the base panel of the cabinet 1. Thereafter, the rear portion 28 of the upper cover 22 is pushed backward. At this time, the upper cover 22 is folded backward, relative to the front plate 21, around the hinges 33, so that that the upper cover 22 is perpendicular to the front plate 21, which stands upright on the base panel of the cabinet 1.

Subsequently, when the upper cover 22 is locked to the condenser 14 using the hook 31, which is provided at a position around the rear edge of the upper cover 22, a semi-circular hook groove 31*a* (see, FIG. 4) of the hook 31 is fitted over the refrigerant pipe 14*b* of the condenser 14. Next, a screw 38 is tightened into both the screw hole 32 which is provided on the rear portion of the upper cover 22, and a screw hole 14*c* which is provided on an upper corner of a right side end of the condenser 14. Thus, as shown in FIG. 3, the assembly of the condenser casing 20, which houses the condenser fan 15 and the condenser 14 therein, is completed. Thereafter, the cover of the cabinet 1 is mounted on the base panel on which the condenser casing 20 is supported.

As shown in FIG. 3, since the condenser 14 is installed in the condenser casing 20, the upper cover 22 covers the upper portion of the condenser 14. Further, the recess part 24 of the front plate 21 covers the left side of the condenser 14 which is bent forward, while the cover part 25 of the front plate 21 covers the right side of the condenser 14. Such a design allows air to efficiently circulate through the condenser 14 by the condenser fan 15, which is placed in front of the condenser 14, as shown in FIG. 4. Therefore, the refrigerant flowing through the refrigerant pipe 14*b* of the condenser 14 is efficiently condensed.

As shown in FIG. 4, the condenser fan 15 is provided in the condenser casing 20 under the rear portion 28 of the upper cover 22 at a position which is offset from the hinges 33, thus defining a sufficient gap between the upper end of the condenser fan 15 and the upper cover 22. Therefore, although the front end of the upper cover 22 may be undesirably bent downward or deformed when the condenser casing 20 is manufactured or assembled, or is used for lengthy periods, the condenser fan 15 does not contact the upper cover 22.

As is apparent from the above description, the present invention provides an integrated air conditioner having a condenser casing which is designed such that a front plate of the condenser casing is coupled to an upper cover, so as to be perpendicular to the upper cover, by a plurality of hinges which are spaced apart from each other at regular intervals. Therefore, a residual stress is not generated in a part of the upper cover around the hinges when the upper cover is bent around the hinges, thus preventing the part of the upper cover around the hinges from being deformed so that the upper cover does not come into contact with the condenser fan. The condenser fan is thus prevented from being damaged, in addition to preventing generation of noise. Further, the present invention provides an integrated air conditioner having a condenser casing, which is designed such that the plurality of hinges are placed in front of the condenser fan, and a step portion is provided at a predetermined position of the upper cover to be inclined upwardly, thus defining a sufficient gap between the condenser fan and the upper cover. Therefore, although the upper cover may be undesirably deformed due to continued usage, the condenser fan does not come into contact with the upper cover, thus allowing the condenser fan to be semi-permanently and reliably operated without being damaged. Further, in an integrated air conditioner having the condenser casing of the present invention, the upper cover of the condenser casing has more structural strength and is easily mounted to an upper portion of the condenser, thus allowing for rapid assembly. The upper cover is rarely deformed even in the case of continued usage.

Although an embodiment of the present invention has been shown and described, it would be appreciated by those skilled in the art that changes may be made in this embodiment without departing from the principles and spirit of the invention, the scope of which is defined in the claims and their equivalents.

What is claimed is:

1. An integrated air conditioner, comprising:

a condenser casing to house a condenser and a condenser fan therein, the condenser casing comprising:

a front plate, an upper cover extending from an upper edge of the front plate, and a plurality of hinges integrally provided between the front plate and the upper cover, spaced apart at regular intervals, wherein the upper cover rotates around the hinges, to be perpendicular to the front plate.

2. The integrated air conditioner according to claim 1, wherein the condenser fan is provided under the upper cover, and the hinges are positioned in front of the condenser fan, so that the condenser fan is operated at a position which is offset from the hinges.

3. The integrated air conditioner according to claim 1, wherein the upper cover comprises:

a step portion provided along a middle portion of the upper cover;

a front portion provided in front of the step portion, the front portion being lower than the step portion;

a rear portion provided in back of the step portion, the rear portion being higher than the step portion;

wherein the step portion, the front portion, and the rear portion are formed as a single structure, and the condenser fan is provided under the rear portion of the upper cover to allow a gap between the condenser fan and the upper cover.

4. The integrated air conditioner according to claim 1, further comprising a hook projected from an inner surface of the upper cover at a rear edge of the upper cover, to lock the upper cover to the condenser.

5. The integrated air conditioner according to claim 4, wherein the condenser comprises a refrigerant pipe, and the hook is provided with an arc-shaped groove corresponding to a shape of the refrigerant pipe so as to fit over the refrigerant pipe.

6. The integrated air conditioner according to claim 4, further comprising a screw hole at a rear portion of the upper cover to couple the upper cover to an upper end of the condenser.

7. The integrated air conditioner according to claim 3, further comprising at least one rim provided along the rear portion of the upper cover, to increase a structural strength of the upper cover.

8. The integrated air conditioner according to claim 3, further comprising a plurality of ribs provided along the step portion at regular intervals to increase the structural strength around the step portion.

9. The integrated air conditioner according to claim 1, further comprising an opening in the front plate so that the condenser fan may be set in the condenser casing through the opening.

10. The integrated air conditioner according to claim 1, further comprising a recess part at a side of the front plate, to receive an extended portion of the condenser.

11. The integrated air conditioner according to claim 1, further comprising a cover part at a side of the front plate, to cover a side of the condenser, preventing air from escaping around the condenser.

12. An integrated air conditioner, comprising:

a condenser casing to house a condenser and a condenser fan therein, the condenser casing comprising:

a front plate, an upper cover extending from an upper edge of the front plate, a step portion provided along a middle portion of the upper cover, and a plurality of hinges integrally provided between the front plate and the upper cover, spaced apart at regular intervals, wherein the upper cover is rotated around the hinges to be perpendicular to the front plate, and the condenser fan is provided under the upper cover at a position behind the step portion so that the condenser fan is offset from the hinges and a gap is provided between the upper cover and the condenser fan.

* * * * *

UNITED STATES PATENT AND TRADEMARK OFFICE

CERTIFICATE OF CORRECTION

PATENT NO. : 7,228,697 B2
APPLICATION NO. : 10/796204
DATED : June 12, 2007
INVENTOR(S) : Kyung Ho Yoon et al.

It is certified that error appears in the above-identified patent and that said Letters Patent is hereby corrected as shown below:

Title Page, Column 2 item (56) (U.S. Patent Documents), Line 1, after "2,939,297 A " change "8/1960" to --06/1960--.

Signed and Sealed this

Sixth Day of November, 2007

JON W. DUDAS
*Director of the United States Patent and Trademark Office*